US006162086A

United States Patent [19]

Kuo

[11] Patent Number: 6,162,086

[45] Date of Patent: Dec. 19, 2000

[54] CABLE END CONNECTOR HAVING AN INNER SHIELDING CASING CAPABLE OF SECURELY RETAINING AND GROUNDING A CABLE THEREIN

[75] Inventor: Peter Kuo, Chung-Ho, Taiwan

[73] Assignee: Hon Hai Precision Ind. Co., Ltd., Taipei Hsien, Taiwan

[21] Appl. No.: 09/318,222

[22] Filed: May 25, 1999

[30] Foreign Application Priority Data

Dec. 8, 1998 [TW] Taiwan ..... 87220445

[51] Int. Cl.[7] ..... H01R 12/24

[52] U.S. Cl. ..... 439/497; 439/579; 439/610

[58] Field of Search ..... 439/497, 579, 439/610, 609, 98, 607

[56] References Cited

U.S. PATENT DOCUMENTS 4,618,202 10/1986 Libregts et al. ..... 439/425
5,032,089 7/1991 Hansell, III ..... 439/609
5,470,238 11/1995 Walden ..... 439/98
5,815,916 10/1998 Luc ..... 29/828
5,934,942 8/1999 Patel et al. ..... 439/610

*Primary Examiner*—Lincoln Donovan
*Assistant Examiner*—Brian S. Webb
*Attorney, Agent, or Firm*—Wei Te Chung

[57] ABSTRACT

A cable end connector includes an insulative outer casing receiving an inner shielding casing therein. The inner casing defines an interior space for receiving a connector body retaining a number of contact elements. The inner casing has resilient arms electrically connected thereto. The connector body has a circuit board to which the contact elements are fixed and electrically connected. The circuit board opposes the resilient arms and defines a space therebetween. A number of cables have leading ends extending into the inner casing. Each cable includes at least a conductor core surrounded by an insulative layer enclosed by a metallic shielding layer. The leading end of each cable is stripped to expose the conductor core to be soldered to the circuit board. The leading ends of the cables are received in the space between the resilient arms and the circuit board whereby the resilient arms are resiliently deformed to securely retain the cables therebetween and electrically engage with the shielding layers thereof for providing grounding effects.

7 Claims, 4 Drawing Sheets

CABLE END CONNECTOR HAVING AN INNER SHIELDING CASING CAPABLE OF SECURELY RETAINING AND GROUNDING A CABLE THEREIN

BACKGROUND OF THE INVENTION

1. Field of the Invention

The present invention generally relates to a cable end connector, and in particular to a cable end connector having excellent grounding properties and mechanical retention for the provision of stable signal transmission.

2. The Prior Art

A cable end connector is usually provided with grounding means for electrostatic discharge and electromagnetic interference suppression purposes. Related techniques are disclosed in Taiwan Patent Application Nos. 86102089 and 86102095. FIG. 4 shows a conventional cable end connector 6 comprising an insulative housing 61 having a mating section 62 defining a slot 63 therein for receiving and engaging with a mating connector (not shown). The slot 63 is further defined with passages 631 for accommodating and retaining contact elements 7 and grounding elements 9 therein.

A number of cables 8 are attached to the cable end connector 6 and electrically connected to the contact elements 7. Each cable 8 comprises a conductor core 81 surrounded by an inner insulative layer 82. A metallic shielding layer 83 encloses the inner insulative layer 82 for electrically shielding the conductor core 81 and eliminating external electromagnetic interference. An outer insulative layer 84 encloses the metal shielding layer 83. A leading end of the cable 8 is stripped to expose the conductor core 81 and the shielding layer 83. The conductor core 81 is received in the corresponding passageway 631 for electrically connecting with the corresponding contact element 7.

As shown in FIG. 5, each grounding element 9 of the conventional cable end connector 7 has a front plate 91 extending into the slot 63 for electrically engaging with the mating connector and two pairs of retaining lugs 92*a*, 92*b* extending in opposite directions for clamping and electrically engaging with the shielding layer 83 of one of the cables 8.

The cables 8 of the conventional cable end connector are not properly secured except for those clamped by the retaining lugs 92*a*, 92*b* of the grounding elements 9. Thus, frequent engagement/disengagement of the cable end connector with/from the mating connector may lead to an undesired separation between contact elements 7 and the corresponding cables 8. Furthermore, the conventional cable end connector does not have a shielding member to protect the contact elements 7 and ends of the cables 8 from electromagnetic interference.

It is thus desirable to have a cable end connector that eliminates the disadvantages associated with the prior art cable end connector.

SUMMARY OF THE INVENTION

Accordingly, an object of the present invention is to provide a cable end connector having cables securely fixed therein for effectively preventing undesired separation of the cables therefrom.

Another object of the present invention is to provide a cable end connector comprising a shielding member arranged inside an outer casing thereof for protecting contact elements of the connector from external electromagnetic interference.

A further object of the present invention is to provide a cable end connector having effectively grounded cables connected to the connector.

To achieve the above objects, a cable end connector in accordance with the present invention comprises an insulative outer casing receiving an inner shielding casing therein. The inner casing defines an interior space for receiving a connector body retaining a number of contact elements. The inner casing has resilient arms electrically connected thereto. The connector body has a circuit board to which the contact elements are fixed and electrically connected. The circuit board opposes the resilient arms and defines a space therebetween. A number of cables have leading ends extending into the inner casing. Each cable includes at least a conductor core surrounded by an insulative layer enclosed by a metallic shielding layer. The leading end of each cable is stripped to expose the conductor core to be soldered to the circuit board. The leading ends of the cables are received in the space between the resilient arms and the circuit board whereby the resilient arms are resiliently deformed to securely retain the cable therebetween and electrically engage with the shielding layers thereof for providing grounding effects.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
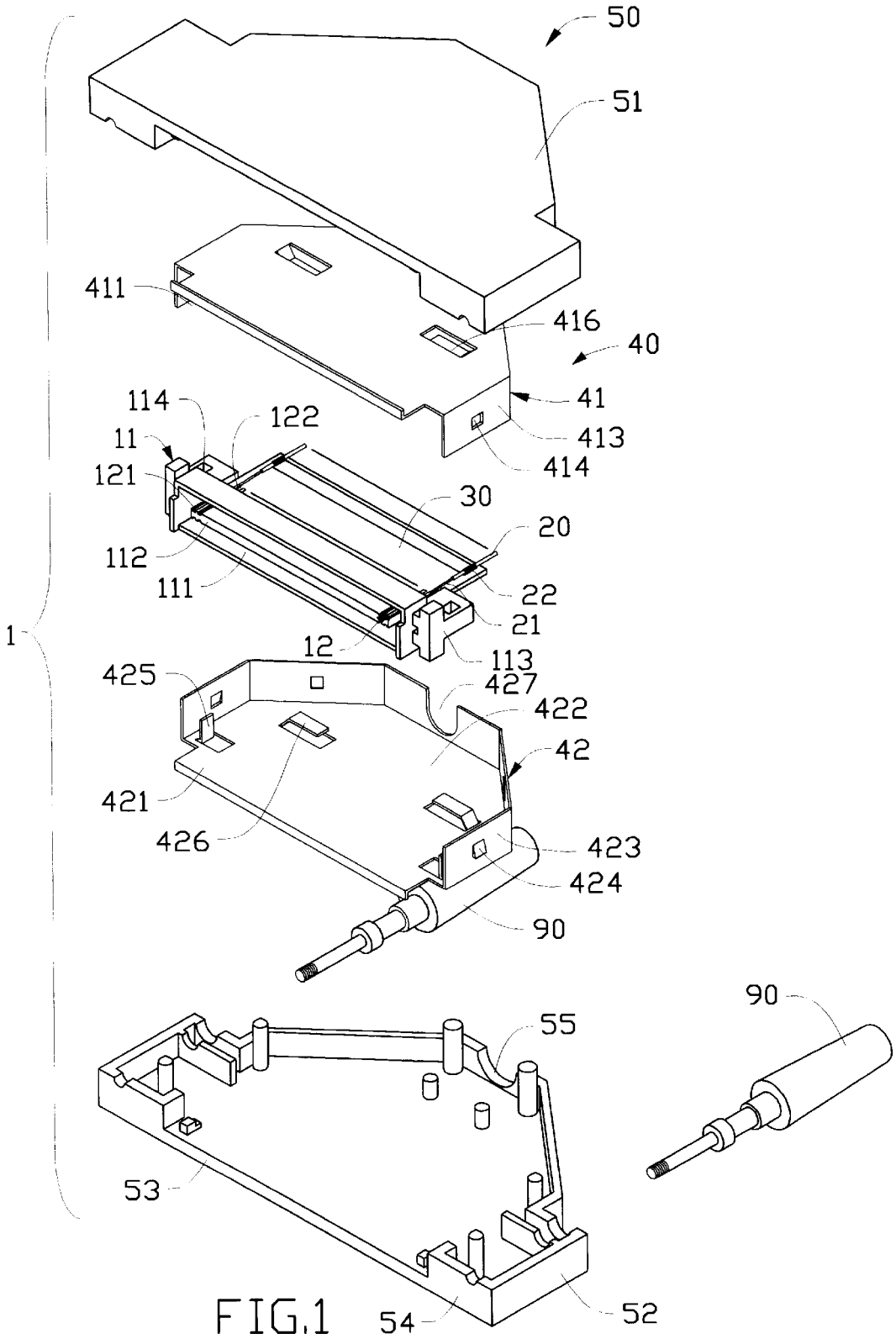
FIG. 1 is an exploded view of a cable end connector constructed in accordance with the present invention.

Referring to the drawings and in particular to FIG. 1, a cable end connector 1 constructed in accordance with the present invention comprises an insulative outer casing 50 having an upper casing member 51 and a lower casing member 52 connected together to define an interior space therebetween for receiving an inner casing 40, preferably made of a metal sheet for serving as a shielding member, and a connector body 11. The outer casing 50 defines an opening 53 in a side wall 54 thereof which will be further described. Two bolts 90 are rotatably supported on the outer casing 50 for fixing the cable end connector 1 to a mating connector (not shown).

The inner casing 40 comprises an upper casing member 41 and a lower casing member 42 each having a side wall 413, 423 overlapping each other. The side wall 423 of the lower casing member 42 comprises outwardly extending barbs 424 engaging with openings 414 defined in the side wall 413 of the upper casing member 41 thereby securing the upper and lower casing members 41, 42 together and defining an interior space therebetween for receiving the connector body 11. The side walls 413, 423 of the upper and lower casing members 41, 42 each define a cutout 411, 421 corresponding in position thereby defining an opening of the inner casing 40 corresponding to the opening 53 of the outer casing 50 through which the connector body 11 is exposed for engaging with the mating connector. The connector body 11 is sandwiched between the upper and lower casing members 41, 42 thereby being retained in the inner casing 40.

The upper and lower casing members 41, 42 of the inner casing 40 have a plurality of resilient arms 416, 426 formed on inside surfaces 422 thereof and opposing each other. Preferably, the resilient arms 416, 426 are stamped on the upper and lower casing members 41, 42 of the inner casing 40. The lower casing member 42 of the inner casing 40 further comprises two positioning tabs 425, preferably stamped thereon.

Figure 2:
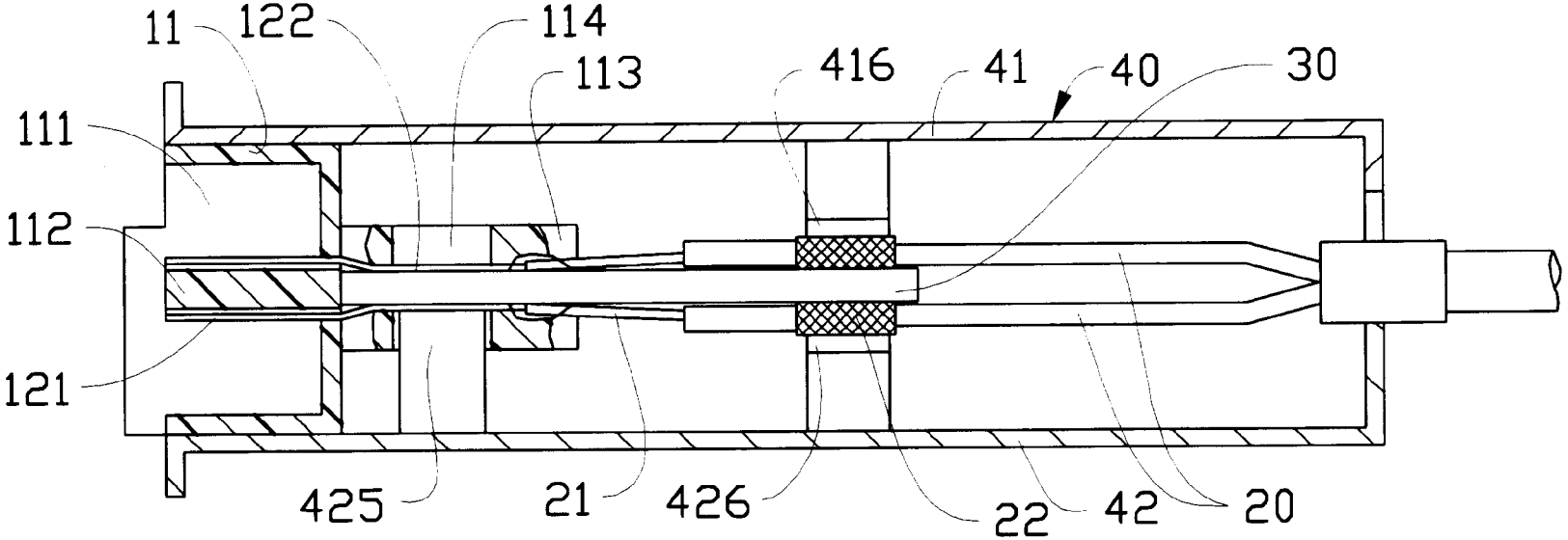
FIG. 2 is a cross-sectional view of the cable end connector of the present invention with an outer casing removed.

The connector body 11 has two support portions 113 formed on opposite ends thereof. Each support portion 113 defines a slot 114 therein. As shown in FIG. 2, the upper and lower casing members 41, 42 of the inner casing 40 fix the connector body 11 therebetween with the positioning tabs 425 of the lower casing member 42 received in the slots 114 of the connector body 11 for securely retaining the connector body 11 in position.

The connector body 11 defines a receiving slot 111 therein which is exposed through the cutouts 411, 421 of the inner casing 40 and the opening 53 of the outer casing 50 for receiving the mating connector. A tongue 112 is arranged and fixed in the receiving slot 111 and defines a number of grooves therein. Each groove receives and retains a mating end 121 of a contact element 12. Each contact element 12 has a tail end 122 extending through the connector body 11 and connected to two opposite surfaces of a circuit board 30 by means of soldering. The circuit board 30 is located between the resilient arms 416, 426 of the upper and lower casing members 41, 42 of the inner casing 40 and defines therebetween a space (not labeled) to be further described.

Referring back to FIG. 1, a number of cables 20 extend through openings 55, 427 defined in the side walls 54 and 413, 423 of the outer and inner casings 50, 40. Each cable 20 has a conductor core 21 surrounded by an inner insulative layer (not labeled) and a metallic shielding layer 22 surrounding the inner insulative layer and enclosed by an outer insulative layer (not labeled). A leading end of the cable 20 extending into the casings 50, 40 is stripped to expose the conductor core 21 and the metallic shielding layer 22 thereof. The conductor cores 21 of the cables 20 are soldered to the circuit board 30 on opposite surfaces thereof to be electrically connected to the contact elements 12.

Figure 3:
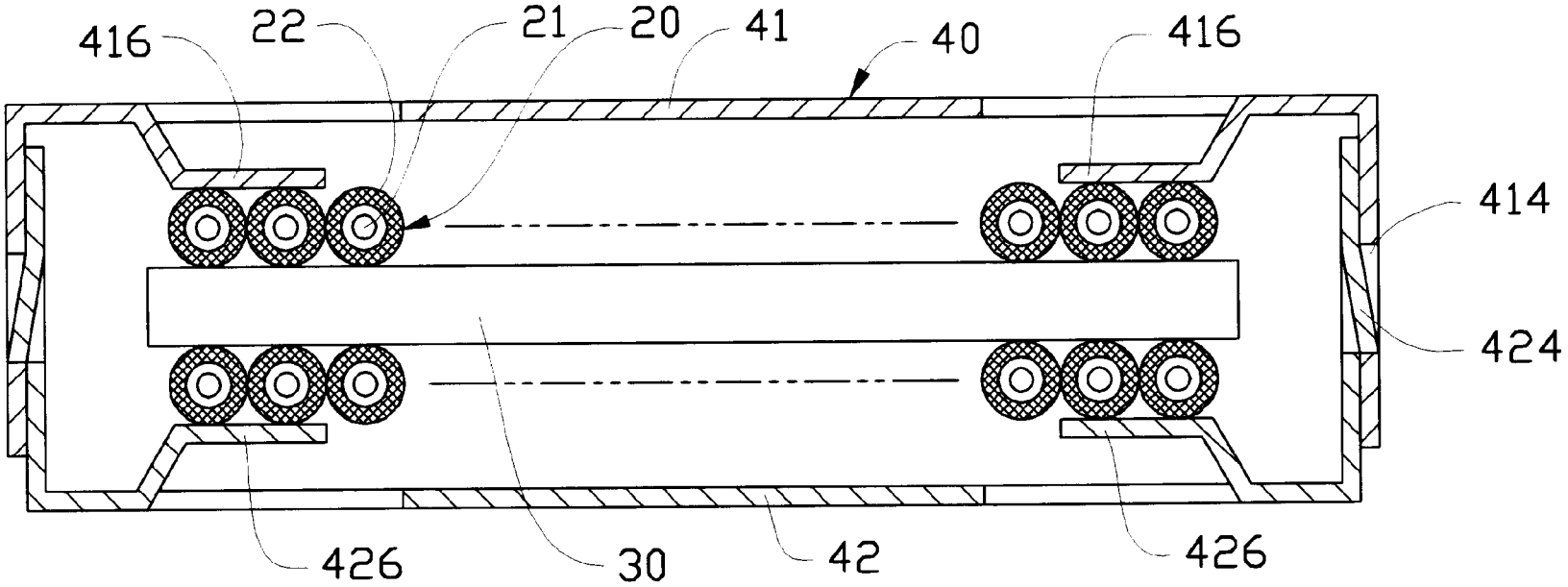
FIG. 3 is another cross-sectional view of the cable end connector of the present invention with the outer casing removed.
Figure 5:
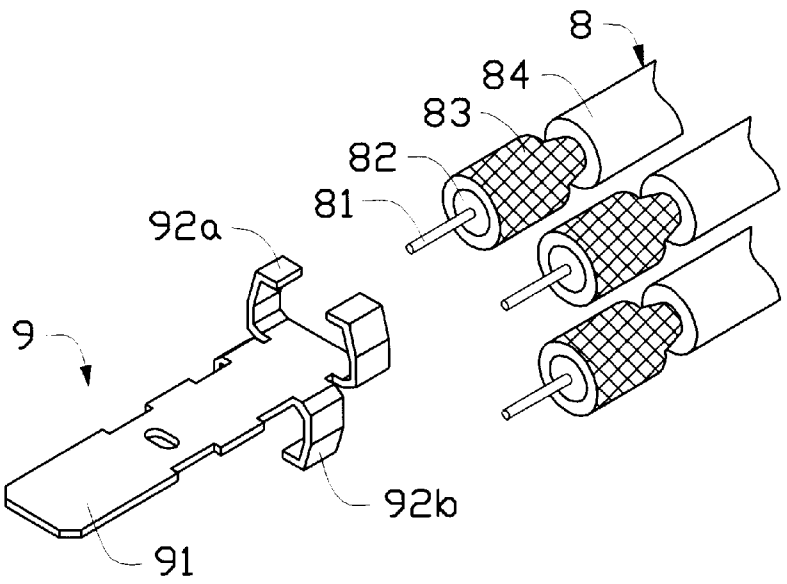
FIG.5 PRIOR ART
FIG. 5 is a perspective view of a grounding element of the conventional cable end connector and cables connected thereto.
Figure 4:
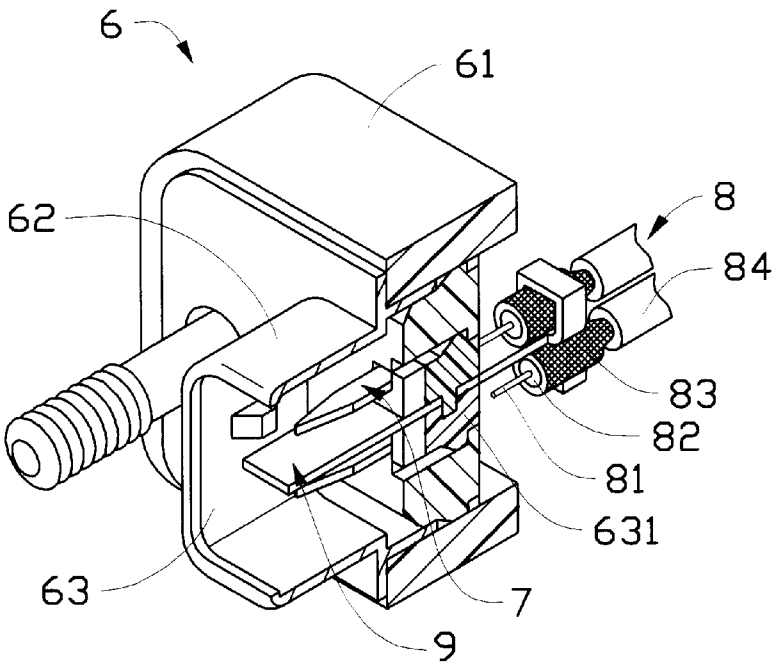
FIG.4 PRIOR ART
FIG. 4 is a perspective view, partially cut away, of a conventional cable end connector.

As shown in FIG. 3, the leading ends of the cables 20 are received in the spaces between the circuit board 30 and the resilient arms 416, 426 whereby the exposed shielding layers 22 thereof are engaged by the resilient arms 416, 426. The cables 20 are interposed between the resilient arms 416, 426 and the circuit board 30 and the resilient arms 416, 426 are resiliently deformed thereby applying a spring force to the cables 20 for securely retaining the cables 20 on the circuit board 30.

The engagement between the shielding layers 22 of the cables 20 and the resilient arms 416, 426 of the inner shielding casing 40 also electrically ground the shielding layers 22 of the cables 20 thereby providing electrostatic discharge and eliminating electromagnetic interference.

Although the present invention has been described with reference to the preferred embodiment, it is apparent to those skilled in the art that a variety of modifications and changes may be made without departing from the scope of the present invention which is intended to be defined by the appended claims.

What is claimed is:

1. A cable end connector comprising an insulative outer casing receiving an inner shielding casing therein, the inner casing defining an interior space for receiving a connector body retaining a number of contact elements therein, the inner casing comprising resilient arms electrically connected thereto, the connector body comprising a circuit board to which the contact elements are fixed and electrically connected, the circuit board opposing the resilient arms and defining a space therebetween, a number of cables having leading ends extending into the inner casing, each cable comprising a conductor core surrounded by an insulative layer enclosed by a metallic shielding layer, the leading end of each cable being stripped to expose the conductor core which is soldered to the circuit board, the leading ends of the cables being received in the space between the resilient arms and the circuit board whereby the resilient arms are resiliently deformed to securely retain the cable therebetween and electrically engage with the shielding layers of the cables for grounding the shielding layers.

2. The cable end connector as claimed in claim 1, wherein the resilient arms are stamped on the inner casing.

3. The cable end connector as claimed in claim 1, wherein the inner casing comprises an upper member and a lower member each having a side wall overlapping and secured to each other.

4. The cable end connector as claimed in claim 3, wherein the side wall of the lower member of the inner casing comprises barbs formed thereon for engaging with openings defined in the side wall of the upper member to secure the upper and lower members together.

5. The cable end connector as claimed in claim 1, wherein the inner casing comprises positioning tabs formed thereon for being received in slots defined in the connector body to retain the connector body in position in the inner casing.

6. The cable end connector as claimed in claim 3, wherein each of the upper and lower members of the inner casing comprises resilient arms formed therein opposing two opposite surfaces of the circuit board, each resilient arm defining a space with the corresponding surface of the circuit board to receive and retain the leading ends of the cables therein.

7. A cable end connector comprising an insulative outer casing receiving an inner shielding casing therein, said inner shielding defining at least one resilient arm extending inward, a connector body being received within said inner shielding, two rows of contact elements retained within said connector body, a circuit board positioned between said two rows of contact elements so as to have the contact elements fixed thereon while being spaced from the resilient arm, a number of cables defining leading ends extending into the inner shielding, each of said cables including a conductor core surrounded by an insulative layer which is enclosed by a metallic shielding layer, the conductor core of each cables soldered on the circuit board, and the resilient arm pressing the corresponding cables against the circuit board wherein the metallic shielding layer of said cable electrically engages said resilient arm.

* * * * *